US005389205A

United States Patent [19]

Pajula et al.

[11] Patent Number: 5,389,205

[45] Date of Patent: Feb. 14, 1995

[54] METHOD FOR DEWATERING OF A PAPER WEB BY PRESSING USING AN EXTENDED NIP SHOE PRE-PRESS ZONE ON THE FORMING WIRE

[75] Inventors: Juhani Pajula; Juha Kivimaa, both of Jyvaskyla; Jorma Lapotti, Palokka; Martti Hirsimaki, Jyska; Pekka Taskinen, Jyvaskyla; Mikko Karvinen, Vihtavuori, all of Finland

[73] Assignee: Valmet Paper Machinery, Inc., Helsinki, Finland

[21] Appl. No.: 26,851

[22] Filed: Mar. 5, 1993

Related U.S. Application Data

[63] Continuation-in-part of Ser. No. 795,043, Nov. 20, 1991, abandoned.

[30] Foreign Application Priority Data

Nov. 23, 1990 [FI] Finland ..... 905798

[51] Int. Cl.[6] ..... D21F 3/06; D21F 9/02; D21F 3/04

[52] U.S. Cl. ..... 162/205; 162/358.3; 162/359.1; 162/360.2; 162/210

[58] Field of Search ..... 162/205, 207, 358.1, 162/358.3, 360.2, 359.1, 210

[56] References Cited

U.S. PATENT DOCUMENTS

| | | | |
|---|---|---|---|
| 3,772,140 | 11/1973 | Kobayashi | 162/133 |
| 3,797,384 | 3/1974 | Hoff | 162/360.1 |
| 4,493,745 | 11/1984 | Wicks et al. | 162/360.1 |
| 4,526,655 | 7/1985 | Karvinen et al. | 162/360.1 |
| 4,556,454 | 12/1985 | Dahl et al. | 162/358 |
| 4,561,939 | 12/1985 | Justus | 162/360.1 |
| 4,576,682 | 3/1986 | Laapotti | 162/360.1 |
| 4,584,059 | 4/1986 | Schiel et al. | 162/361 |
| 4,879,001 | 11/1989 | Cronin | 162/360.1 |
| 4,909,903 | 3/1990 | Mullner | 162/358.1 |
| 4,915,790 | 4/1990 | Dahl | 162/360.1 |
| 4,917,768 | 4/1990 | Ilmarinen | 162/358 |
| 4,921,575 | 5/1990 | Page | 162/358 |
| 4,931,143 | 5/1990 | Karvinen et al. | 162/360.1 |
| 4,943,351 | 7/1990 | Wedel | 162/205 |
| 4,976,821 | 11/1990 | Laapotti | 162/360 |
| 5,043,046 | 8/1991 | Laapotti | 162/358 |
| 5,071,513 | 12/1991 | Bluhm et al. | 162/360.1 |

FOREIGN PATENT DOCUMENTS

| | | |
|---|---|---|
| 0345500 | 12/1989 | European Pat. Off. . |
| 0345501 | 12/1989 | European Pat. Off. . |
| 14372 | 1/1972 | Finland . |
| 823643 | 1/1984 | Finland . |
| 66932 | 7/1984 | Finland . |
| 3328162 | 2/1985 | Germany . |
| 3604522 | 9/1986 | Germany . |
| 2218122 | 11/1989 | United Kingdom . |
| 8500841 | 2/1985 | WIPO . |
| 8808051 | 10/1988 | WIPO . |
| 9108339 | 6/1991 | WIPO . |

OTHER PUBLICATIONS

Albany International "Paper Machine Felts and Fabrics" pp. 64–68, 1976.

D. Holle, "Siebbespannung fur die Pressenpartie—Vacoflex", vol. 43, issue 11 (1989).

*Primary Examiner*—Karen M. Hastings

*Attorney, Agent, or Firm*—Steinberg, Raskin & Davidson

[57] ABSTRACT

Method and device in the manufacture of paper or board for dewatering of a paper web that is being manufactured. The paper web is transferred from a forming wire onto a wire in the drying section while constantly on support of a fabric that receives water, a transfer fabric, or of any other, corresponding transfer surface as a closed draw, at a particularly high speed, which is higher than about 25–30 m/s. Dewatering of the paper web is carried out by means of at least two subsequent press nips, of which nips at least one press nip is a so-called extended-nip zone, whose length in a machine direction is larger than about 100 mm. The extended-nip zone is formed in connection with a mobile flexible press-band loop. The distribution of the compression pressure employed within said extended-nip press zone is regulated and/or selected both in the transverse direction of the web and in the machine direction so as to set or to control the different profiles of properties of the web.

20 Claims, 12 Drawing Sheets

METHOD FOR DEWATERING OF A PAPER WEB BY PRESSING USING AN EXTENDED NIP SHOE PRE-PRESS ZONE ON THE FORMING WIRE

This application is a continuation-in-part of U.S. Ser. No. 07/795,043, filed Nov. 20, 1991, now abandoned.

BACKGROUND OF THE INVENTION

The invention concerns a method in the manufacture of paper or board for dewatering of a paper web that is being manufactured and that has been drained in the former of the paper machine. In the method, the dewatering takes place by passing the paper web on support of fabrics that receive water through a number of subsequent dewatering nips. In this manner, by the effect of the compression pressure, water is transferred out of the fiber mesh of the paper web into the spaces in the fabric that received water as well as into the spaces in the hollow faces of the mobile dewatering members, such as press rolls.

Further, the invention concerns a press section of a paper machine, into which the paper web to be dewatered by pressing is passed from the former of the paper machine and from which the paper web is passed into the drying section of the paper machine. The press section comprises at least two separate press-nip zones, two press fabrics that receive water passing through at least the first one of said press-nip zones, between which fabrics the web runs through said nip zone.

One of the most important quality requirements of all paper and board qualities is uniformity of the structure both microscopically and macroscopically. The structure of paper, in particular of printing paper, must also be symmetric. The printing properties required from printing paper include good smoothness, evenness and certain absorption properties at both faces. The properties of paper, in particular the symmetry of density, are affected considerable by the operation of the press section in a paper machine, which has also a decisive significance for the evenness of the transverse profiles and longitudinal profiles of the paper.

Increased running speeds of paper machines provide new problems, which are mostly related to the running quality of the machine. At present, running speeds of up to about 1400 m/min are employed. At these speeds, so-called closed press sections, which comprise a compact combination of press rolls fitted around a smooth-faced center roll, usually operate satisfactorily. Such press sections are commercially available from the assignee of the present application, Valmet Oy, under the tradenames "Sym-Press II TM" and "Sym-Press O TM". One item that requires development is the center roll in the compact press sections and the material of the roll, which has commonly been rock, which, however, being a natural material, has certain drawbacks.

Dewatering by means of pressing is energy-economically preferable to dewatering by evaporation. This is why attempts should be made to remove a maximum proportion of water out of a paper web by pressing in order that the proportion of water that must be removed by evaporation could be made as low as possible. However, the increased running speeds of paper machines provide new, as yet unsolved, problems expressly in the dewatering taking place by pressing, because the press impulse cannot be increased sufficiently by the means known in prior art. This is because, at high speeds, the nip times remain unduly short and, on the other hand, the peak pressure of compression cannot be increased beyond a certain limit without destruction of the structure of the web.

When the running speeds of paper machines are increased, problems of running quality of paper machines are also manifested with increased emphasis, because a watery web of low strength cannot withstand an excessively high and sudden impulse of compression pressure or the dynamic forces produced by high speeds, but web breaks and other disturbance in operation are produced with resulting standstills. With a modern printing paper machine, the cost of a break standstill is at present about 40,000 FIM, about $8,000, per hour.

Further drawbacks of the prior art press sections include the requirement of suction energy of the suction rolls commonly employed in them as well as the noise problems arising from the suction rolls. Also, the suction rolls with their perforated mantles, interior suction boxes, and other suction systems are components that are expensive and require repeated servicing.

Further problems which are manifested with more emphasis at high speeds of paper machines and for which, at least not for all of them, satisfactory solutions have not yet been found, include the quality problems related to the requirements of evenness of the longitudinal and transverse property profiles of the paper web. The evenness of the web that is produced also affects the running quality of the whole a paper machine, and it is also an important quality factor or finished paper, which is emphasized in respect of copying and printing papers when the requirements on the speeds of copying and printing machines and on the uniformity of the printing result are increased. The property profiles of the paper that is produced in the machine direction are also significantly affected by oscillations of the press section, the transverse variations of properties by the transverse profiles of the nip pressures in the press nips. With increasing running speeds of the machine, these profile problems tend to be increased remarkably.

Recently, running speeds even as high as about 40 m/s, or 2400 m/min, have been contemplated as running speeds of paper machines. The realization of such high speeds, in particular in wide machines, creates ever more serious problems to be solved, of which problems some of the most important ones are the running quality of the machine and adequate dewatering capacity at high speeds.

With respect to the prior art most closely related to the invention, reference is made to U.S. Pat. Nos. 4,483,745 (Beloit Corp.), 4,526,655 (Valmet Oy), 4,561,939 (Beloit Corp.) as well as to the published patent applications WO-85/00841 (J. M. Voith GmbH), DE-OS-3742848 (Sulzer-Escher Wyss GmbH), and to the FI Patent Applications 842114 (Valmet Oy), 842115 (Valmet Oy) and 850665 (Valmet Oy).

OBJECTS AND SUMMARY OF THE INVENTION

An object of the present invention is to provide novel solutions for the problems discussed above so that the above-mentioned drawbacks and others in the prior art are substantially avoided.

It is another object of the present invention is to provide a method for dewatering of appear web by pressing at high speeds, in particular at speeds of from about 25 to about 40 m/s, so that the adjustability of the press section is versatile, the properties of quality of the web produced can be kept high, and the web is not subjected to excessive dynamic forces that produce breaks.

It is a further object of the invention to provide an overall construction of the press section, in particular its frame construction, such that the replacement of press rolls and press fabrics can be accomplished quickly so as to minimize the standstill times.

In view of achieving the objects stated above, and others, the method of the invention is mainly characterized in that the method comprises a combination of the following steps. First, the paper web is transferred from a forming wire onto a wire in the drying section while constantly on support of a fabric that receives water, a transfer fabric, or of any other, corresponding transfer surface as a closed draw, preferably at a speed that is from about 30 to about 40 m/s. The dewatering of the paper web is carried out by means of at least two subsequent press nips, of which nips at least one press nip is a so-called extended-nip zone, whose length in the machine direction is larger than z>about 100 mm. The extended-nip zone is preferably formed in connection with a mobile flexible press-band loop. The distribution of the compression pressure employed within the extended-nip press zone is regulated and/or selected both in the transverse direction of the web (WE) and in the machine direction so as to set or to control the different profiles of properties of the web.

The web is transferred in the press nips of the present invention so that there is a substantially non-rewetting transfer of the web between the press fabrics running through at least one of the press nips in the press section. Preferably, there is a non-rewetting transfer of the web after the last press nip in the press section because the web has then the highest possible dry solids content achievable in the press section. If rewetting occurs at this stage, some of the dry solids content is lost, i.e. lowered. This arrangement is in contrast to prior art devices wherein two water-receiving fabrics are invariably used in the last nip in the press section to ensure that water is removed symmetrically through both surfaces of the web and achieve a symmetric structure of the web.

On the other hand, the press section in accordance with the invention comprises a combination as follows. Press and transfer fabrics are fitted in such a way that the paper web to be pressed has a closed draw supported by a press fabric from the pick-up point to the drying section, to the transfer point, without free, unsupported draws. An arrangement of press fabrics and press rolls forms at least two separate press zones that dewater the web, between which press zones the web has said closed draw supported by a fabric in the arrangement. At least one of the arrangements forms an extended-nip press zone, which is formed between a hose roll or a band roll and an opposite press roll. In the extended-nip press zone, the web is transferred between opposing fabrics.

An important aspect of the method and the device of the invention that the paper web is not passed through the press section on one press fabric, but, to guarantee an adequate dewatering capacity, an arrangement of fabrics is employed in which the web is transferred from the pick-up point on the first upper fabric through the first press zone, preferably an extended-nip zone, through which zone the first lower fabric runs. The web is transferred from the first lower fabric onto the second upper fabric, which carries the web into the second nip zone. The second nip zone comprises a roll nip or preferably an extended-nip zone, after which the web is transferred onto the second lower fabric, which runs through said nip zone and carries the web on its upper face as a closed draw onto the drying wire or into the next nip zone.

In a preferred embodiment, the web is carried on only one fabric before the extended-nip press zone and on only one opposing fabric after the extended-nip press zone. Thus, only when the web is being transferred in the extended-nip press zone is the web sandwiched between a first press fabric and a second press fabric. Otherwise, the web runs on only one press fabric. In this embodiment, a suction box preferably helps detach the web from the first press fabric relatively soon after the extended-nip press zone.

In the present invention and in its various embodiments, it has been possible to successfully combine certain component solutions in a novel and inventive way, some of which solutions are in themselves known in paper machine technology, so that the problems discussed above, which are of different natures, have been brought under control and been solved by means of a novel overall concept.

An important object achieved by means of the invention is a satisfactory running quality of the paper machine even at speeds as high as from about 30 to about 40 m/s. This has been achieved because of a "linear" draw of the web and by a nip arrangement that provides sufficiently long nip times. The closed draw in accordance with the invention has been accomplished so that one and the same fabric does not carry the web through the whole press zone, but in at least two subsequent press zones two pairs of press fabrics are employed, the web being transferred onto the first upper fabric at the pick-up point, and after the first nip zone, the web is transferred from the first lower fabric onto the second upper fabric. After the second nip zone, the web is transferred on the second lower fabric onto the drying wire or into the next nip zone, whose lower fabric carries the web onto the drying wire as a closed draw. Thus, it has been made possible by virtue of the present invention to accomplish a sufficiently high dry solids content in the dewatering taking place by pressing, and the running quality remains at a good level.

The method and the press section in accordance with the invention are intended for use above all with thin paper qualities, whose grammage is lower than about 120 g/m$^2$ and with which a closed draw of the web is indispensable at the high web speeds meant in the invention.

The invention also achieves a sufficiently cautious and gentle start of the dewatering, which is important because at high speeds the water contents in the web after the former also tend to be higher.

According to the invention, when extended-nip presses accomplished by means of hose rolls or band rolls and provided with a number of different possibilities of setting or active regulation are employed, it is also possible to control the profiles of properties of the web both in the machine direction and in the transverse direction.

In a most advantageous embodiment of the invention, a new extended-nip press, which has been developed by Valmet Oy and is marketed by Valmet Oy under the trade mark "Sym-Belt S TM" and which is based on the use of a so-called hose roll, is utilized in a novel way. When fitted in its environment in accordance with the invention, the "Sym-Belt S TM" provides several advantages of synergism, of which should be mentioned that said press produces practically no oscillations at all, for which reason it is well suitable also for very high speeds. The press permits keeping of the nip loads at a sufficiently low level in particular in the initial part of the press section and makes it possible to keep the nip times at a reasonable level even at very high speeds, e.g., from about 30 m/s to about 40 m/s.

A further important feature of the invention is the use of two press fabrics and their joint operation so that the web is transferred as follows: from the pick-up point onto the first upper fabric, after the first nip zone onto the first lower fabric, from the first lower fabric by means of a transfer-suction roll or equivalent onto the second upper fabric, and on the second upper fabric further after the second nip zone onto the second lower fabric. The web is transferred on the second lower fabric as a close draw onto the drying wire or into the next press zone, in whose connection there is a pair of press and transfer fabrics similar to those described above.

Further, the "Sym-Belt S TM" provides entirely novel possibilities to control and to regulate the distribution of the nip pressures in the extended-nip zone both in the machine direction and in the transverse direction.

Further advantages include low power consumption, elimination of difficulties of oil treatment, reduced wear of the mantle of the hose roll, and reasonable dry solids content of the web even at high speeds, e.g. from about 30 m/s to about 40 m/s.

With respect to the details of the construction of the hose rolls, reference is made to U.S. Pat. No. 4,584,059, hereby incorporated by reference, as well as to the assignee's FI Patent No. 66,932 and FI Patent Applications Nos. 892517 and 892518.

One possible manner to accomplish the extended-nip zone employed in the invention is the press solution described in FI Patent Application No. 891380, in which the press band loop is relatively short and has a run guided by a press shoe and a leading roll or an equivalent guide member, and in which solution the ends of the band have been sealed in an novel way. Thus, there is no risk of oil splashes, and the distributions of the nip pressures both in the machine direction and in the transverse direction are adjustable.

Moreover, the invention is related to a press frame solution which is suitable expressly for its environment and which provides advantages of synergism, because of which press frame solution the press rolls and fabrics can be replaced relatively quickly, which, for its part, increases the overall degree of operation of the paper machine and the economy of the paper machine investment.

BRIEF DESCRIPTION OF THE DRAWINGS

In the following, the invention will be described in detail with reference to a number of different embodiments of the invention illustrated in the figures in the accompanying drawing, the invention not being strictly confined to the details of said embodiments.

DETAILED DESCRIPTION OF THE INVENTION

Accordingly, the common features of construction of the press geometries of the press sections as shown in FIGS. 1 to 4 will be described. As is shown in FIGS. 1 to 4, with a closed draw of the web in a paper or board machine, the press section comprises a first upper fabric 20 that receives water, onto which fabric the web W is transferred on the suction zone 21*a* of the pick-up roll 21 at the pick-up point P from the forming wire 10, whose return run starts from the wire drive roll 12.

Figure 1:
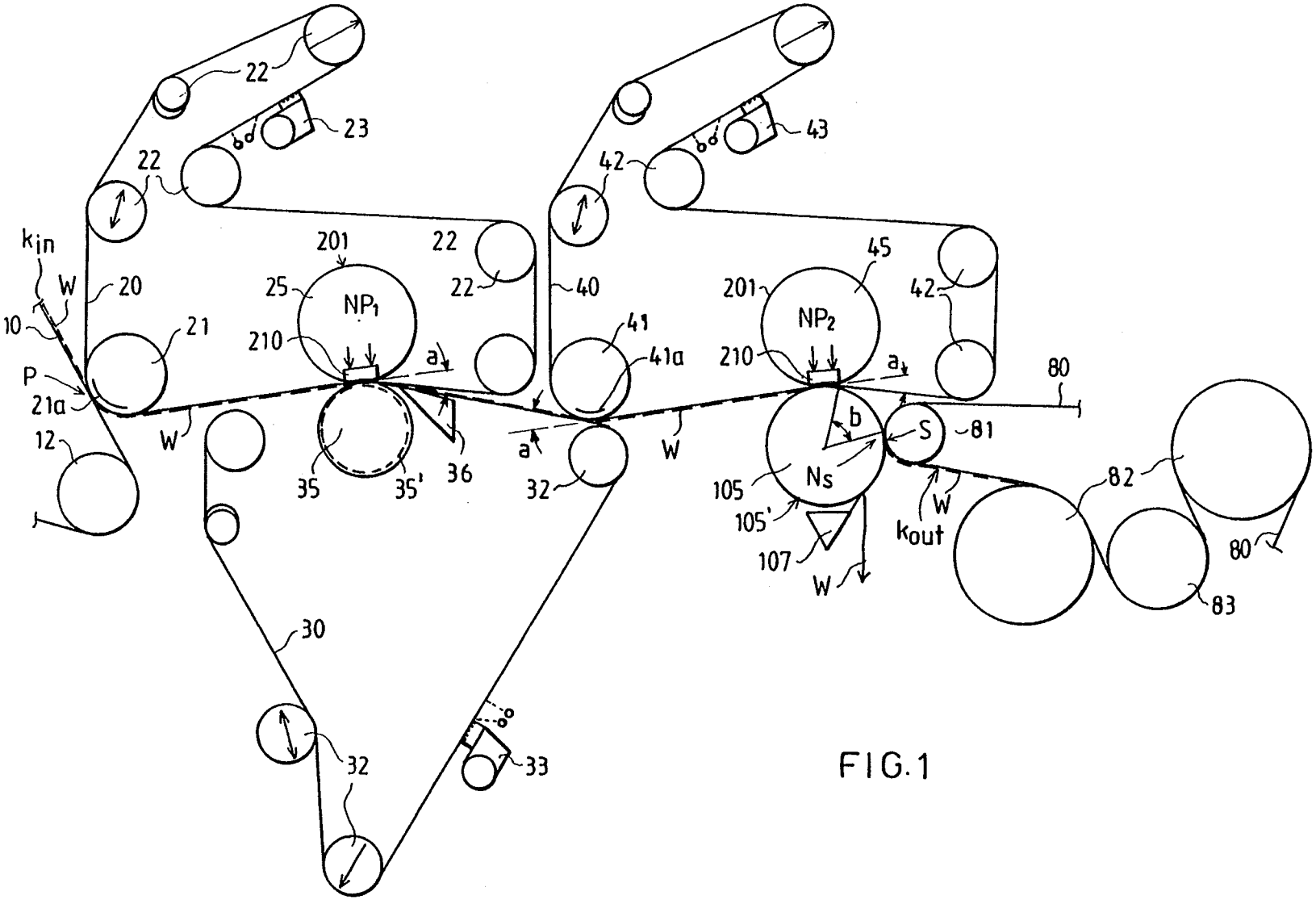
FIG. 1 shows an embodiment of the invention provided with two subsequent "Sym-Belt S TM", of which extended nips one press fabric is employed in the latter nip.
Figure 2:
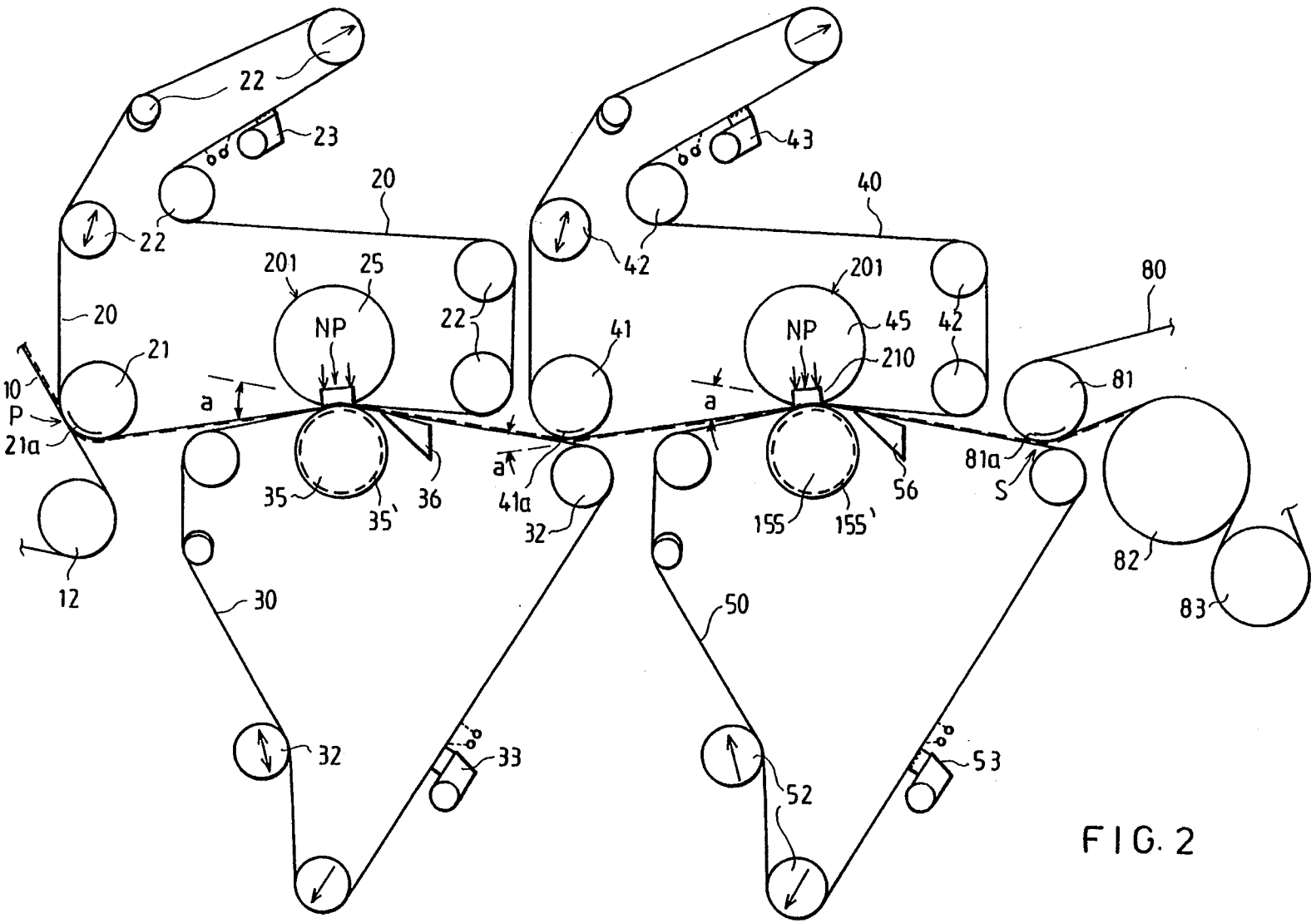
FIG. 2 shows a variation of the press section as shown in FIG. 1 in which, in the second "Sym-Belt S TM" extended nip, a lower press and transfer fabric are also employed, which contributes to the formation of the closed draw to the drying section.
Figure 3:
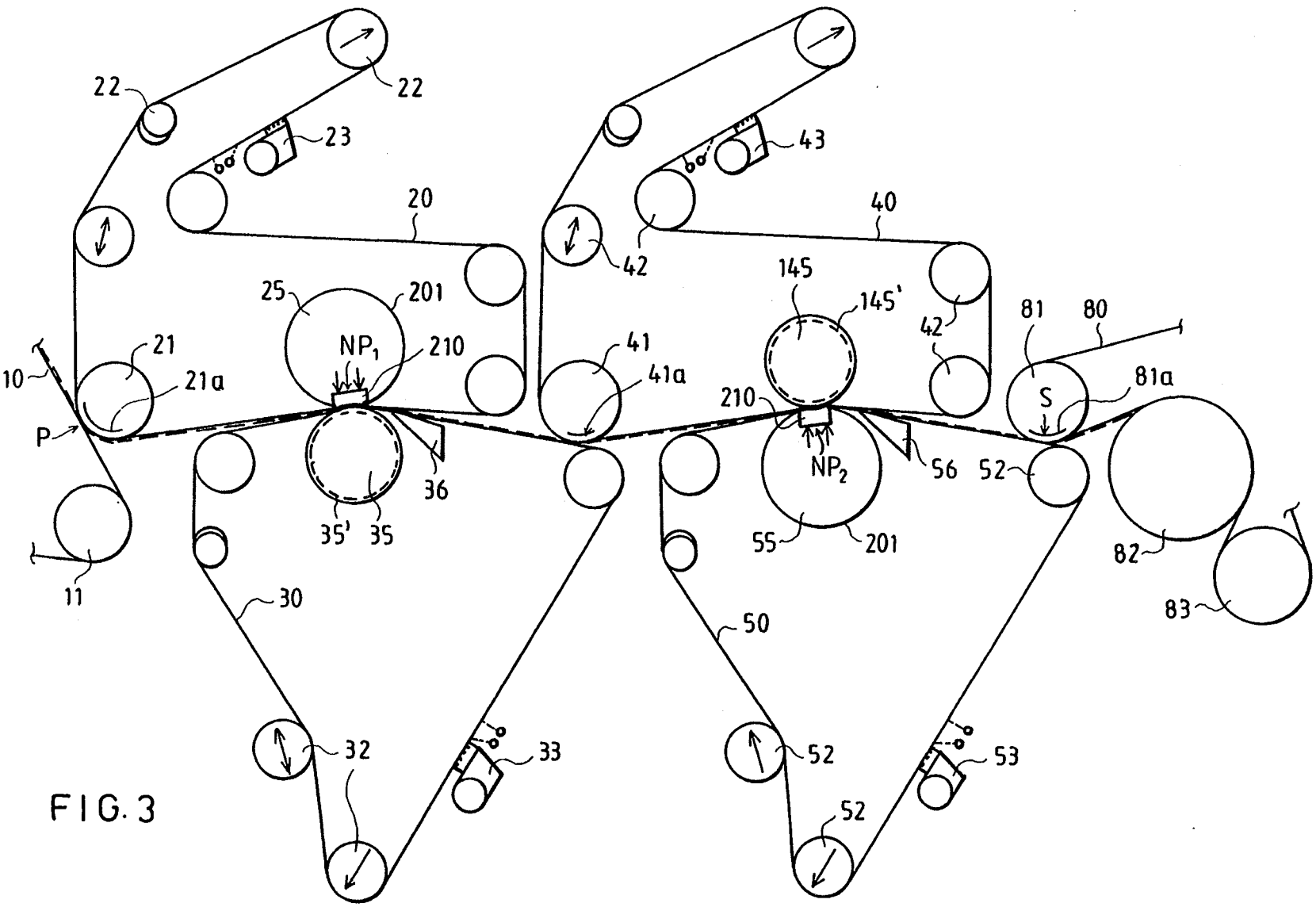
FIG. 3 shows another embodiment of the invention in which two subsequent "Sym-Belt S TM" extended nips are employed which operate in opposite directions, as compared with one another.

According to FIGS. 1 to 4, the press has two subsequent press nips, which remove water from the web W efficiently and between which the web W has a fully closed draw so that it is constantly supported by a fabric. In FIGS. 1, 2 and 3, both nips $NP_1$ and $NP_2$ are so-called extended nips, whose press zone is substantially longer than that in a normal sharp roll nip. The more detailed embodiments of the extended nips will be returned to later, mainly in connection with the descriptions related to FIGS. 10, 11 and 12.

Figure 4:
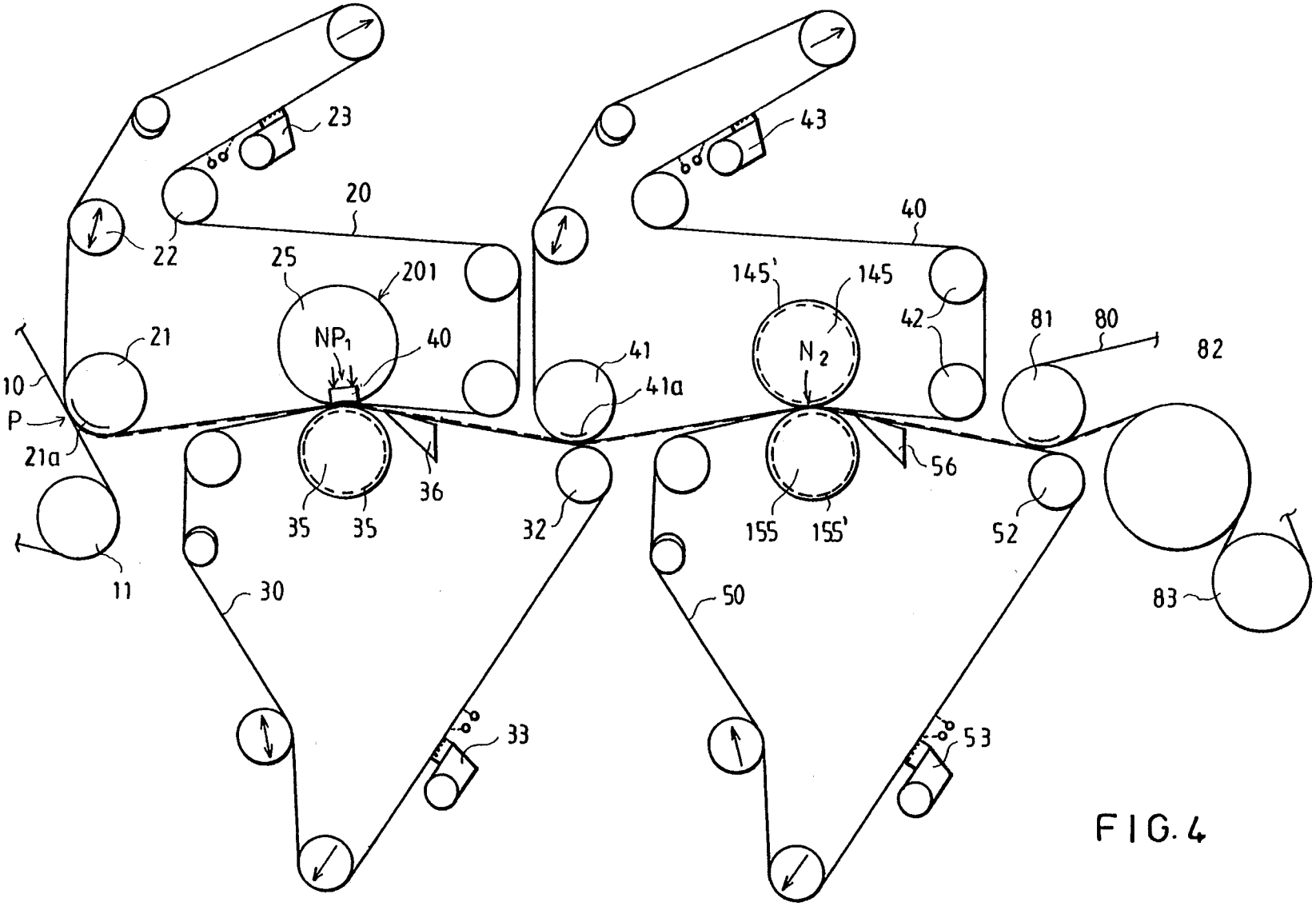
FIG. 4 shows another embodiment of the invention in which the first nip is a "Sym-Belt S TM" extended nip and the second nip is a two-fabric roll nip.
Figure 5:
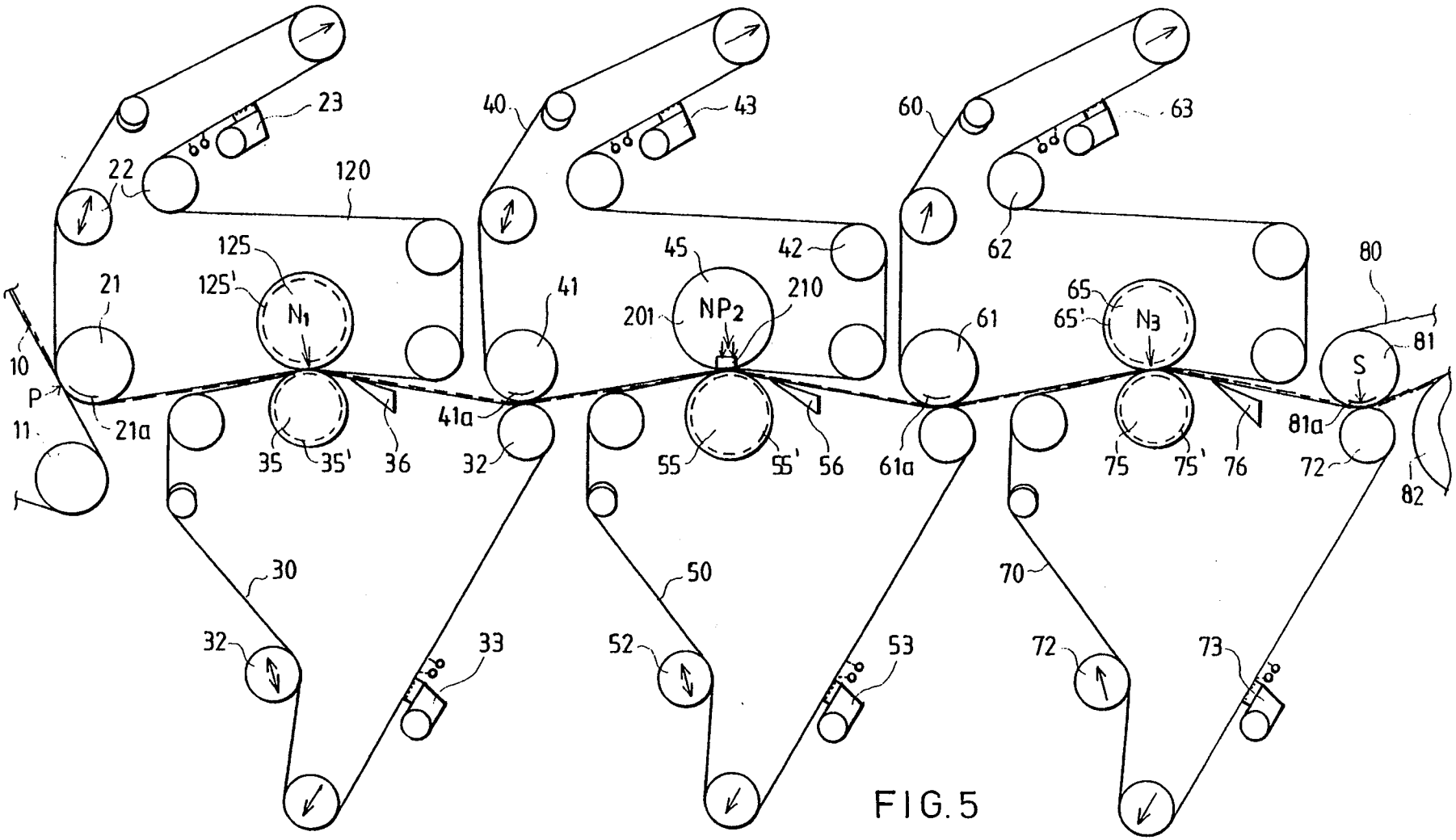
FIG. 5 shows an embodiment of the invention that has a high dewatering capacity and in which three subsequent press nips are employed, of which the first and the last nip are roll nips and the middle nip is a "Sym-Belt S TM" extended nip.

In FIGS. 2–6 and 7, a steam box H is placed opposite a suction device I in an area when the web runs on a upper fabric 40 before the last press nip in the press section $NP,NP_2,N_2,N_3$. The steam box H and suction device I enable the dry solids content of the web to be increased. This is important especially at high running speeds of the paper machine in order to ensure that an adequate dry solids content will be reached. In FIG. 5, a steam box H/suction device I arrangement is also placed between the first press nip $N_1$ and the second press nip $NP_2$.

In FIG. 4, the first nip $NP_1$ is an extended nip, and the second nip a sharp roll nip $N_2$ formed between hollow-faced rolls. In FIGS. 2 to 7, all the nips may be provided with two press fabrics that receive water, so that the water is removed from them through both faces of the web W. It is also possible to use one or several transfer fabrics that do substantially not receive water, instead of said press fabric.

In FIGS. 1 to 4, the first upper fabric is guided by alignment, tensioning and guide rolls 22 and conditioning devices 23. The first extended nip $NP_1$ includes a lower fabric 30 that receives water, being guided by alignment, tensioning and guide rolls 32 and conditioned by conditioning devices 33. The first extended nip $NP_1$ and so also the second extended nip $NP_2$ are accomplished in a Figure "Sym-Belt S TM" of the assignee, and the details of the construction of said press will be discussed later. In respect of its main features, the construction of the press is such that the extended nip $NP_1$ is composed of a flexible hose mantle and of a backup roll. Inside the hose mantle, there is a hydrostatically and/or hydrodynamically lubricated glide shoe 210, the hydraulic loading means fitted in connection with said shoe pressing the shoe 210 against the hollow-faced backup roll 35, 55. The fabrics 20,30 and the web W are running between the shoe 210 and the backup roll 35,55. The backup roll 35, 55 is a hollow-faced press roll, for example the assignee's adjustable-crown "Sym-Z Roll TM"

According to FIGS. 1 to 4, the press section includes a second upper fabric 40, onto which the web W is transferred as a closed draw by means of the suction zone 41*a* of the suction roll 41. After the first nip $NP_1$, it is ensured that the web W follows the first lower fabric 30 by means of a suction box 36 or a corresponding foil arrangement. The second upper fabric 40 is guided by alignment, tensioning and guide rolls 42 and conditioned by conditioning devices 43.

According to FIG. 1, the second extended nip $NP_2$ is also formed in connection with a hose roll 45, which is similar to the hose roll at the extended nip $NP_1$. The lower press member at the nip $NP_2$ is a smooth-faced 105' press roll 105, in connection with whose lower sector a doctor 107 operates, which doctors the web Wo going to broke handling and the leader band to the broke handling arrangement placed below (not shown). The smooth face 105' of the press roll 105 makes sure that, after the extended nip $NP_2$, the web W follows the face 105' of the lower roll 105, from which it is detached by means of a transfer nip $N_s$ and is transferred on support of the drying wire 80, which is guided by the guide roll 81, to the drying section, of which the first heated drying cylinders 82 and leading cylinders 83 are shown in the figures. Single-wire draw is employed at least in the first cylinder group in the drying section.

The web is detached substantially immediately after the extended nips $Np_1$ and $Np_2$ from the upper fabrics 20,40. Before the extended-nips $Np_1$ and $Np_2$, the web is carried on only the upper fabrics 20,40 so that the upper fabrics 20,40 are able to absorb as much water from the web as possible. In nip $Np_1$, both of the fabrics 20,30 are preferably ordinary water-receiving and rewetting fabrics such as press felts. However, in the second and last nip, $Np_2$, one of the fabrics is preferably a substantially water non-receiving and non-rewetting fabric or a smooth faced roll 105 while the other fabric 40 may be an ordinary fabric.

The press section illustrated in FIG. 2 differs from the press section shown in FIG. 1 in the respect that the second extended nip $NP_2$ is a two-fabric nip and includes a lower fabric 50, which is guided by the tensioning, alignment and guide tolls 52 and conditioned by the conditioning devices 53. The extended nip $NP_2$ is formed between the upper hose roll 45, the press fabrics 40, 50, and the lower, hollow-faces 155' press roll 155. After the extended nip $NP_2$, it is ensured, by means of a suction box 56 and/or by means of the surface properties of the fabric 50, that the web follows the lower fabric 50. The lower fabric 50 is preferably a substantially water non-receiving and non-rewetting transfer fabric. From the fabric 50, the web W is transferred as a closed draw onto the drying wire 80 as aided by the suction zone 81*a* of the suction roll 81, and further in the drying section 82, 83, at least at the beginning, as a single-wire draw.

In the press section illustrated in FIG. 2, the two successive extended nips $Np_1$ and $Np_2$ are arranged so that the extended nip shoes are on the same side of the web, i.e. arranged to press against the upper fabrics 20,40. In the last press nip $Np_2$, the web has achieved the highest possible dry solids content. Therefore, in order to prevent a reduction in the dry solids content, the web W is preferably transferred to a substantially impervious and non-water receiving fabric 50 which does not rewet the web so that the water which has been absorbed into the upper fabrics 20,40 does not come into contact with the web to thereby rewet the web. As a result of the low perviousness of the fabric 50 and a smooth face provided on fabric 50, the web W will follow the fabric 50 more reliably after the last press nip. The web is carried on the lower fabric 30 or lower roll 105, or other corresponding transfer surface, after the extended nips $Np_1$ and $Np_2$ so that there is a substantially non-rewetting transfer of the web between the upper fabric before at least one of the nips, preferably the last one $Np_2$, and the lower fabric or roll after the nips. In other words in the at least one nip, the upper fabric 20 does not contact the web and thereby avoids rewetting the web after the upper fabric 20 has been separated. However, in the first nip $Np_1$, both of the fabrics are preferably ordinary water-receiving and rewetting fabrics, such as press felts.

FIG. 3 differs from the press section described above in relation to FIG. 2 in the respect that, in the second extended nip $NP_2$, the hose roll 55 is placed underneath inside the loop of the press fabric 50, and the upper backup roll is a hollow-faced 145' adjustable-crown press roll 145, which is placed inside the loop of the second upper press fabric 40. The web W is transferred after the second nip $NP_2$ on the lower fabric 50 to the transfer point S where the suction zone 81*a* of the suction roll 81 is placed, by whose means the web W is transferred as a closed draw onto the drying wire 80.

In the press section illustrated in FIG. 3, the two successive extended nips $Np_1$ and $Np_2$ are arranged so that the extended nip shoes are on opposite sides of the web, i.e. $Np_1$ is arranged to press against the upper fabric 20 and $Np_2$ is arranged to press against the lower fabric 50.

The embodiment of the invention shown in FIG. 4 differs from those shown in FIGS. 2 and 3 in the respect that the second nip $N_2$ is a roll nip provided with two press fabrics 40, 50 and formed between two hollow-faced 145' and 155' press rolls 145, 155, which are preferably adjustable-crown rolls.

Figure 6:
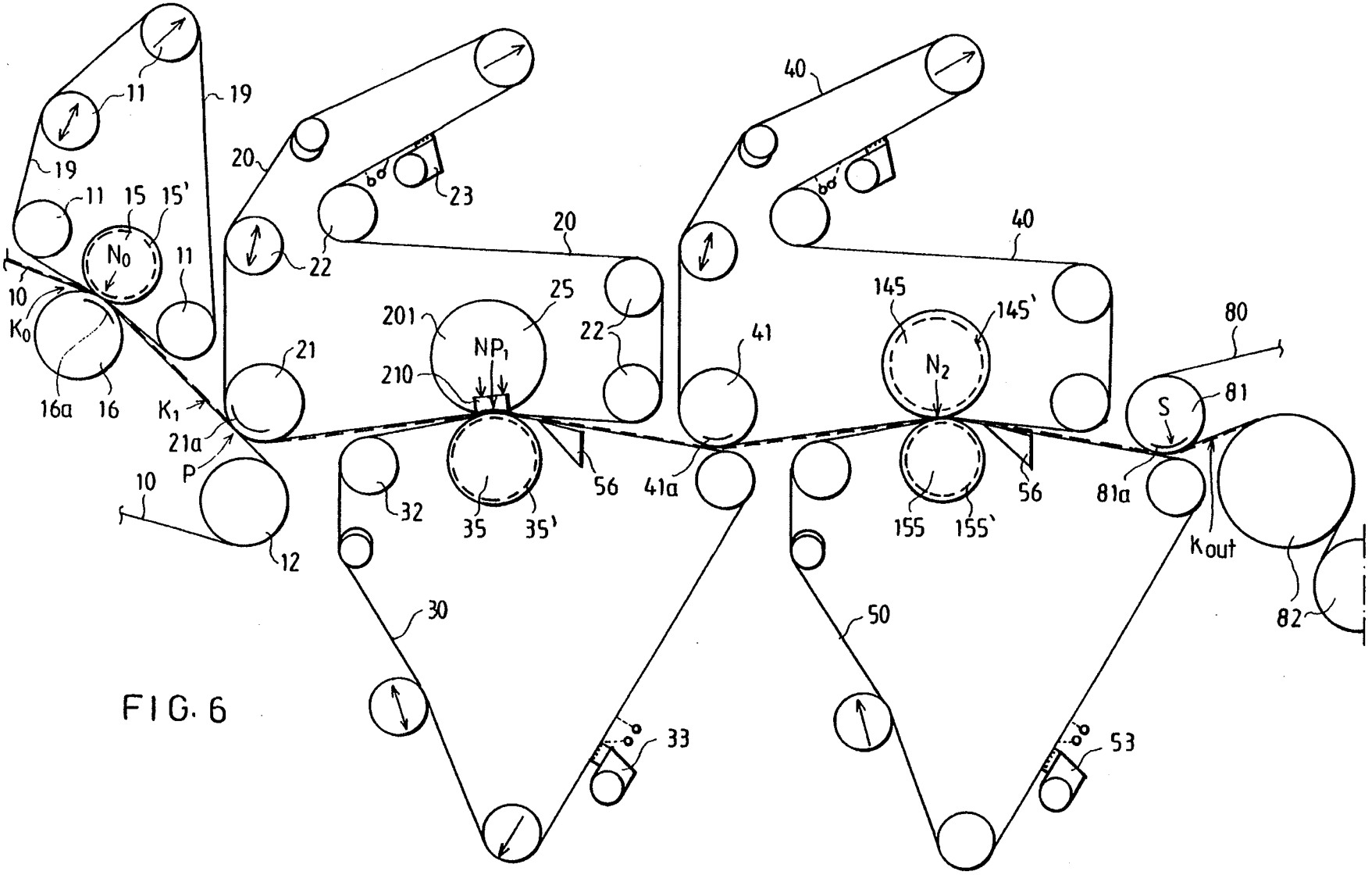
FIG. 6 shows an embodiment of the invention that is intended for particularly high speeds and in which the first nip operates as a so-called wire press, which is followed by an extended nip, and the last nip is a roll nip.

FIGS. 5 and 6 show an embodiment of the invention that is suitable for use at very high paper machine speeds, e.g. in a speed range from about 30 to about 40 m/s, and, if necessary, also with relatively thick paper qualities.

In FIG. 5, the first press nip $N_1$ is a so-called wire press, and therein the first fabric 120 is a relatively loose wire-like press fabric, onto which the web W, which has a very high water content and low strength as yet, is transferred on the pick-up zone 21*a* of the pick-up roll 21 at the pick-up point P from the forming wire 10 proper. The wire press nip $N_1$ is formed between two press rolls 125 and 35, both of which press rolls have very open hollow faces 125' and 35' The lower fabric 30 is a press fabric 30 that receives water, onto which fabric the web W is transferred after the nip $N_1$ by the effect of the adhesion and surface properties of the suction box 36 and/or of the press fabric 30. From the fabric 30, the web W is guided onto the face of the second upper press fabric 40 by means of the suction zone 41*a* of the suction roll 41 placed inside the loop of said fabric 40.

In the press section shown in FIG. 5, the second nip proper is an extended nip $NP_2$ in which the upper press member consists of the hose roll 45 and the lower press member of the hollow-faced 55' press roll 55. Through the extended nip $NP_2$, a press fabric 50 runs, on which the web W is transferred onto the third upper press fabric 60 on the suction zone 61*a* of the suction roll 61, and further into the third, sharp press nip $N_3$, which is formed between hollow-faced 65' and 75' press rolls 65, 75. After the nip $N_3$, the web W follows the lower third fabric 70, which is guided by the tensioning, alignment and guide rolls 72 and conditioned by the conditioning devices 73. From the third lower fabric 70, the web W is detached at the transfer point S on the suction zone 81*a* of the suction roll 81 and transferred onto the drying wire 80. Drying wire 80 carries the web W as a single-wire draw through the first drying group in the dryer.

FIG. 6 shows a version of the invention that differs from FIG. 5 in the respect that the first wire press nip $N_0$ is placed in connection with the wet wire 10 proper so that, before the wire 10 drive roll 12 and the pick-up point P, a suction roll 16 that is provided with an open face and with a suction zone 16*a* is placed inside the loop of the forming wire 10. A press roll 15 is placed against the suction roll 16, which operates inside the loop of the press wire 19, which is provided with a very open mantle face 15', and which is guided by the guide rolls 11. Through the wire press nip $N_0$, a relatively open press fabric 19 runs, which receives water and is well permeable to water. In FIG. 6, the roll 15 may be a hollow-faced 15' steel roll or any other hollow-faced roll of low-weight construction, e.g., a roll with a composite mantle. In FIG. 6., the roll 16 is preferably a wire suction roll. The roll may however, also be some other hollow-faced roll, and in such a case, the wire suction roll is placed after the roll 16 separately.

According to FIG. 6, the wire W, which has been pre-pressed in the wire press nip $N_0$, is transferred at the pick-up point P onto the first upper press fabric 20 proper, which carries the web into the first extended nip $NP_1$ similar to that described above, and from said nip further, on the first lower fabric 30, with the aid of the suction zone 41*a*, onto the second upper fabric 40, which carries the web W into the two-fabric roll nip $N_2$, from which the web W follows the second lower fabric 50 and is transferred on support of said fabric, at the transfer point S, from the suction zone 81*a* onto the drying wire 80.

In the embodiment depicted in FIG. 6, the dry solids content $k_0$ of the web W before the wire press nip $N_0$ is of an order of about 10%, and in a press as shown in the figure, the dry solids content $k_1$ at the pick-up point P is of an order of about 20%.

Figure 6A:
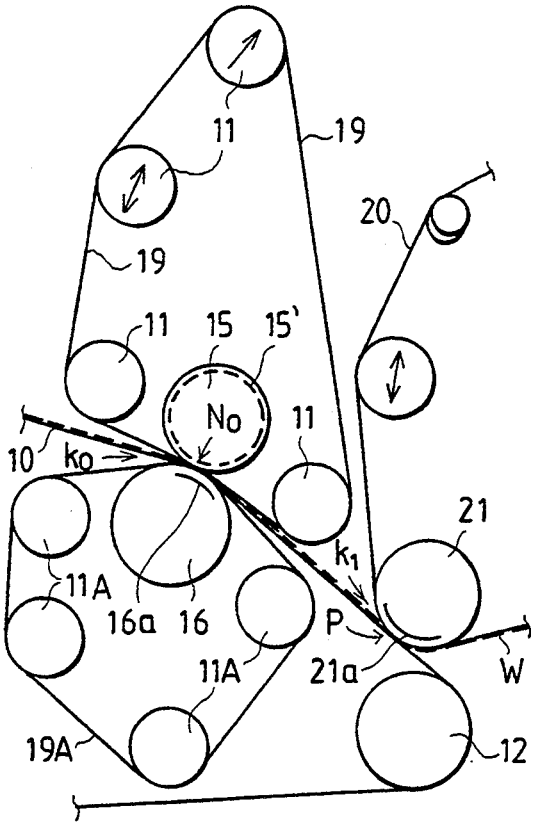
FIG. 6A shows an alternative embodiment of a wire press.

FIG. 6A shows such a variation of the wire press nip as shown in FIG. 6 in which a wet wire 10 and two press fabrics 19 and 19A that operate at opposite sides of the wire 10 are employed. The lower press fabric 19A at the nip $N_0$ is placed inside the wire 10 loop and is guided by the guide rolls 11A.

Figure 6B:
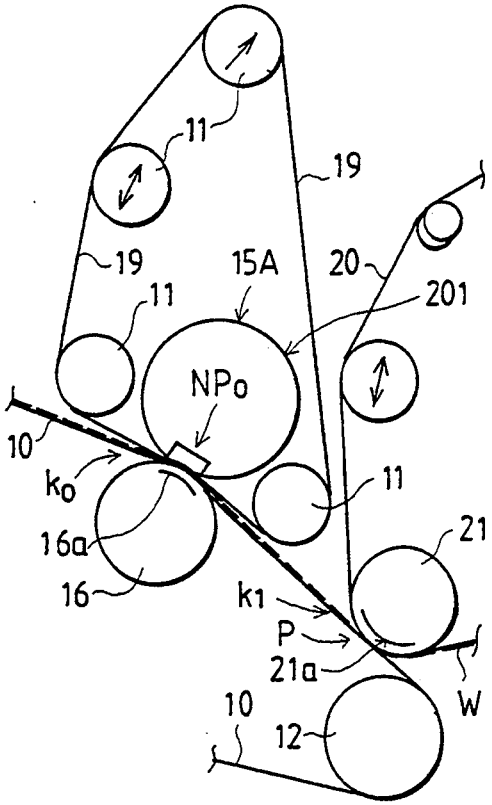
FIG. 6B shows a second alternative embodiment of a wire press.

According to FIG. 6B, instead of a roll nip $N_0$, an extended nip $NP_0$ is used as the wire nip. The construction of the nip $NP_0$ corresponds to those of the nips $NP_1$ and $NP_2$, and it is formed between a hose roll 15A provided with a smooth or hollow-faced glide-belt mantle 201 and a suction roll 16. The pressure in the extended-nip zone $NP_0$ is generally in the range from about 0.5 to about 3 MPa. The length of the nip zone $NP_0$ is most preferably in the range of z=from about 100 to about 600 mm.

Figure 6C:
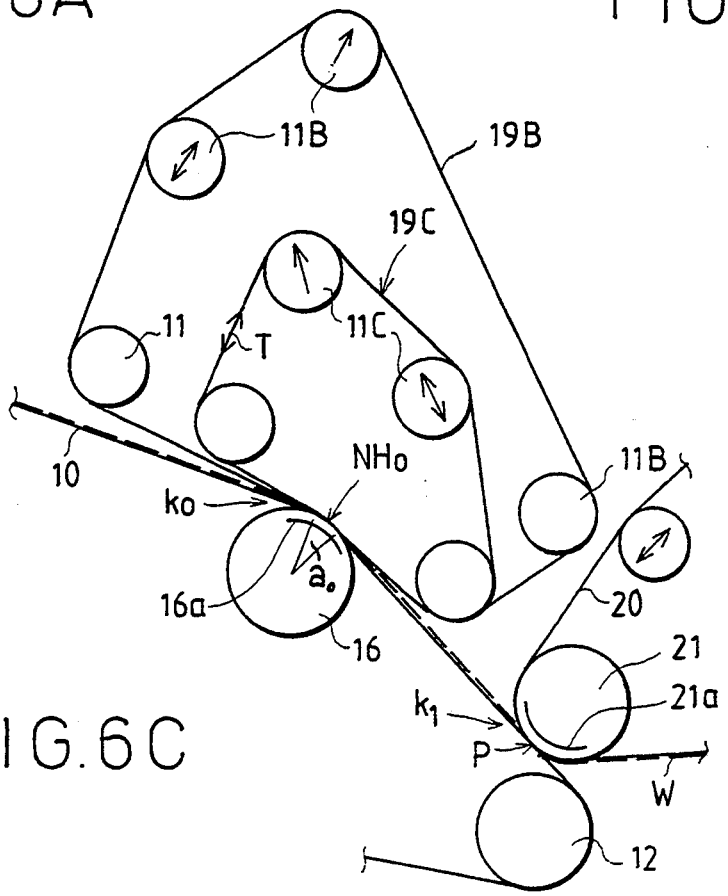
FIG. 6C shows a third alternative embodiment of a wire press.

FIG. 6C shows a variation of the invention in which a belt-tensioned nip $NH_0$ is employed. Nip $NH_0$ is formed between a wet wire 10 and a press fabric 19B that run over a suction roll 16. Inside the loop of the press fabric 19B, which is guided by the guide rolls 11B, a smooth-faced or hollow-faced tensioning belt 19C is arranged, which is guided by the guide rolls 11C. The tension T of the tensioning belt 19C produces a compression pressure P=from about 0.01 to about 0.5 MPa in the press zone $a_0$. The length of the press zone $a_0$ is most preferably in the range from about 100 to about 500 mm. In the other respects, the construction is similar to that described above in relation to FIGS. 6, 6A and 6B.

In some particular cases, the method in accordance with the invention can be carried out and the press section in accordance with the invention be constructed so that the only extended nip in the press section is exactly the extended nip $NP_0$ operating in connection with the wet wire 10 or some other, corresponding extended nip, in which case, the rest of the nips in the press section are roll nips, for example, relatively long roll nips between press rolls of relatively large diameters.

In view of the above, the web W has a closed and supported draw as it moves from the pick-up point P on the forming wire 10 to the point S, at which it is transferred onto the drying wire 80 of the drying section and further as a supported single-wire draw at least through the first drying group. The fact that, after each nip, the web W follows the fabric that is supposed to carry it forwards is ensured by means of various suction or foil devices, covering angles of the press fabrics, and/or adhesion properties of the fabrics. Of these devices, the suction boxes 56 are shown in the figures.

Referring to FIGS. 6,6A,6B and 6C, the pre-pressing nip $N_0$ is also referred to as a draining pressing wherein water is removed from the web while the web is carried throughout the pre-pressing nip on the forming wire 10 until the pick-up point P. In this pre-pressing nip, there is no transfer of the web from one fabric to another. Rather, the web travels on the forming wire through the nip while an additional open fabric, or a second wire, 19 contacts the web and is pressed in the nip so as to absorb water from the web. The second wire 19 is thereafter removed from contact with the web after the pre-pressing nip and does not carry the web.

The advantages of a press section having three wire nips $N_0$, $NP_0$, $NH_0$ as illustrated in FIGS. 6, 6A,6B,6C include obtaining higher than normal running speeds of a paper machine, which speeds are higher than 25 m/s. In press sections wherein the web runs at high speeds without a wire nip, the web is too wet when it comes from a former to a press section. This makes the transfer of the web and the subsequent pressing stages problematic. The advantageous feature of pre-pressing the web by introducing a permeable press wire which contacts the forming wire in a press nip but does not carry the web results in a significant advantage obtained in the press section in accordance with the present invention. In this manner, an increase in the dry solids content of the web is achieved which is beneficial to the operation and efficiency of the subsequent press nips in the press section.

From FIGS. 1 to 7, it can be concluded directly that the run of the web W to be processed through the press section is highly linear without major curves. Owing to the linear path of the web, the dynamic forces applied to the web remain sufficiently low in view of minimizing the risk of breaks.

In preferred embodiments, the magnitude of the angle a of change in the direction of the web W is in the range of a=from about 10° to about 30° and a<15°. An exception to this may be formed by the pick-up roll 21 and its suction zone, at which locally even a high negative pressure may be employed, as well as, in FIG. 1, by the smooth-faced 105' lower press roll 105 and its turning sector b. Out of the reasons stated above, a press geometry as shown in FIG. 1 is not preferable when the maximum speed range (i.e., from about 30 m/s to about 40 m/s) of the applications of the invention is employed.

In the press constructions described above, the closed draw is accomplished so that it has been possible to minimize the dynamic forces applied to the web W and the risk of breaks. Thus, the running quality is satisfactory even at high speeds (from about 30 m/s to about 40 m/s). Moreover, when extended nips $NP_1$ and $NP_2$ accomplished by means of hose rolls 200;300 have been employed in a press section in accordance with the invention, it has been possible to ensure a sufficient dewatering capacity and dry solids content even at high speeds without applying compression stages of excessively high peak pressures to the web W. It is a further important property of the extended-nip presses employed in the invention that practically no oscillations arise therein.

It is a further feature of the invention that the length z of the extended-nip zones $NP_1$ and $NP_2$ (z being in the range of z=from about 100 to about 300 mm) in the machine direction is sufficiently large that sufficiently long nip times are produced at said high speeds (e.g. from about 30 m/s to about 40 m/s) as well as a sufficient compression impulse even though the peak pressure of the compression is kept reasonable and such that even a web with a very high water content (for example, $k_0 \approx 10\%$) can be pressed without deterioration of the structure of the web.

The length z of the extended-nip zones $NP_1$ and $NP_2$ in the machine direction in the invention is preferably always z>from about 100 to about 300 mm, preferably z=about 200 mm. In such a case, in the extended nips $NP_1$ and $NP_2$, it is possible to use maximal compression pressures, which are of the order of p=from about 3 MPa to about 9 MPa, preferably in the range of p=from about 5 MPa to about 8 MPa. In the roll nips $N_0$, $N_1$, $N_2$, $N_3$, it is, of course, possible also to use higher peak pressures, for example $P_{max}$=about 11 MPa. Generally, however, a relatively low peak pressure must be used in the first roll nip, in which the water content of the web is high: $P_{max}$=from about 2.5 MPa to about 4 MPa.

As can be ascertained from FIGS. 1 to 6, the passage of the paper web W through the entire press section is highly "linear" and substantially horizontal.

In the following, with reference to FIGS. 7, 8 and 9, a frame construction of a press section in accordance with the invention will be described, which frame construction provides advantages of synergism with the construction of the rest of the press section. This synergism is above all related to an increased availability and increased degree of operation of the machine thereby that the overall construction of the press, including its frame components, has been designed such that disturbances of operation should occur to a minimal extent, possible disturbances of operation could be eliminated quickly, and that the rolls and the various fabrics can be replaced quickly, so that standstills remain short in this respect.

Figure 7:
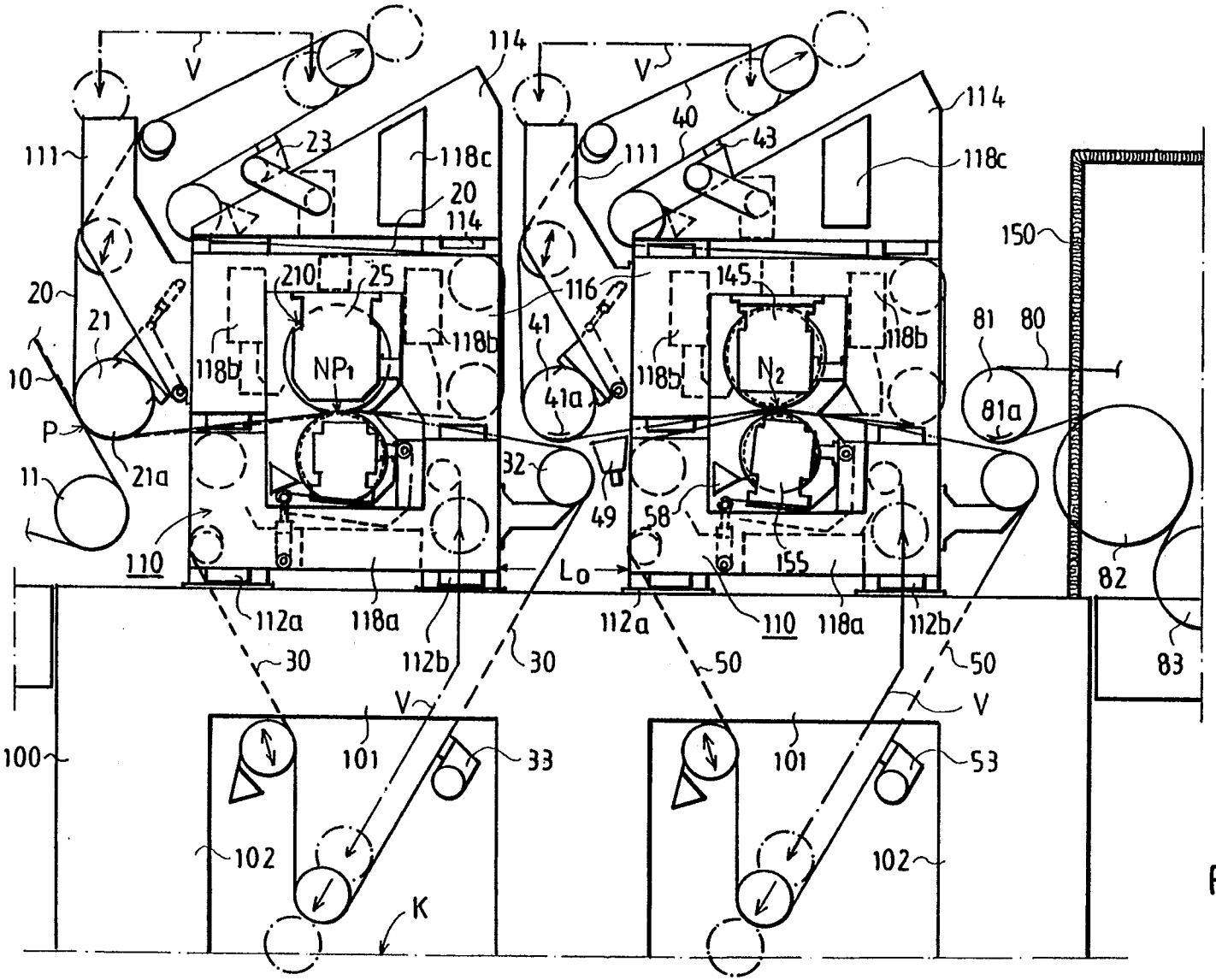
FIG. 7 shows a press solution mainly in accordance with FIG. 4 as provided with a frame construction particularly suitable in connection with the invention.

According to FIG. 7, the frame of the press comprises two substantially identical cantilevered press frame units 110, of which the first unit 110 is provided for the first extended-nip press $NP_1$ and the second unit for the latter extended-nip press $NP_2$. The press frame units 110 are placed one after the other on foundation constructions 110. The foundation constructions 100 consist of horizontal beams 101 and vertical beams 102, which extend into the basement space KE. The top sides of the beams 101 determine the floor level L of the paper machine hall. The frame units 110 are quite closed, and they are placed at a relatively short open horizontal distance $L_0$ from one another. The gap $L_0$ is placed at the point where the web W is transferred from the lower fabric 30 onto the upper fabric 40.

Further, FIG. 7 shows a steam box 49, which is placed after the suction zone 41*a* of the suction roll 41 and by whose means the outer face of the web W is affected so that its temperature level is raised and, thereby, the dewatering is promoted in the nip $N_2$ by affecting the elastic properties of the web W and the viscosity of the water present in the web. FIG. 7 further shows a part of the forward end of the hood 150 of the drying section.

Figure 8:
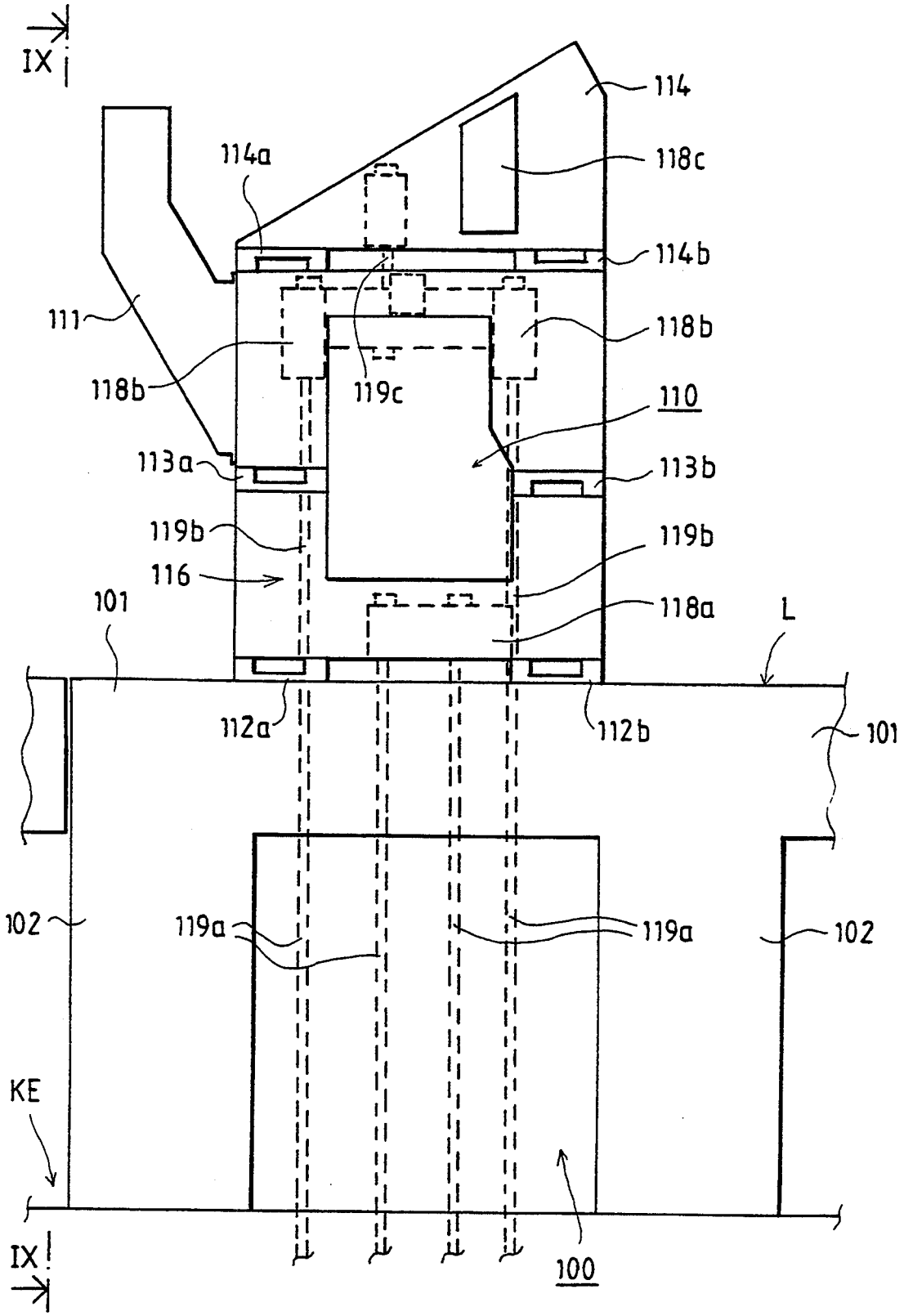
FIG. 8 is a side view of a frame module applicable in the invention.
Figure 9:
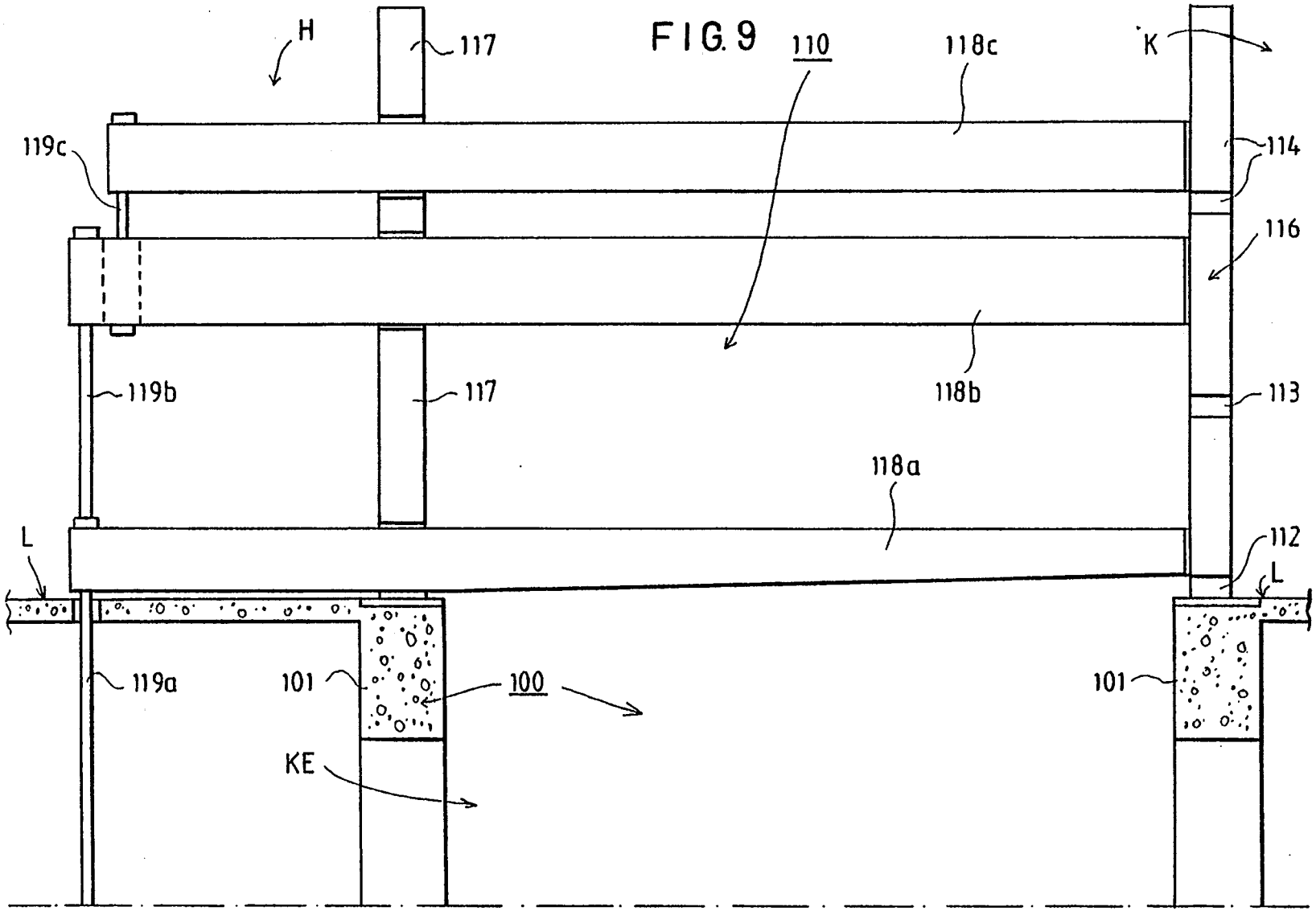
FIG. 9 is a vertical sectional view along the line IX—IX in FIG. 8.

According to FIGS. 8 and 9, the frame units 110 comprise vertical frame beams 116 at the driving side K of the paper machine and corresponding frame beams 117 at the operating side H. The transverse cantilevered parts of the frame unit 110 comprise a lower horizontal beam 118*a* and upper horizontal beams 118*b*, of which latter beams there are two beams placed side by side, and of a horizontal upper beam 118*c*. Said beams are supported on the vertical frame parts 117 at the operating side as well as on draw members 119*a*, 119*b* and 119*c*; by tensioning said draw members in a way in itself known, it is possible to support the horizontal beams 118*a*, 118*b*, 118*c* so that the intermediate pieces 112*a*, 112*b*, 113*a*, 113*b*, 114*a*, 114*b* at the driving side K can be opened for replacement of the fabrics 20, 30, 40, 50. The frame units 110 are highly compact, however, so that replacements of the press fabrics and rolls can be carried out quite quickly.

In FIG. 7, the arrows V illustrate the guide rolls 20, 30, 40, 50 of the various fabrics as shifted to inner positions to their parking sites so that the press fabrics 20, 30, 40, 50 can be replaced as a smaller loop while the rest of the fabric loop has been wound onto replacement poles (not shown), so that the press fabrics are spread and tensioned into their positions afterwards. The front part of the frame unit 110 is provided with a projection part 111, in connection with which the suction rolls 21 of the upper fabrics 20;40 as well as the foremost tensioning and guide rolls are mounted.

The side frames of the press sections shown in FIGS. 7 and 8 are in such a way open that the press rolls can be replaced by pulling to the side, because replacement straight upwards is impossible because of the closed compact constructions of the press frames. Replacements of the press fabrics 20, 30, 40 and 50 are carried out in a way known in prior art by making use of tensioning members 119*a*, 119*b*, 119*c*, by opening the intermediate pieces 112, 113, 114, and by shifting the outermost leading or tensioning rolls, which are placed inside the fabric loops and shown in FIG. 7, into connection with the frames into the inner positions in the directions indicated by the arrows V. Through the intermediate pieces 112, 113, 114, the drying fabrics, which have been opened as a smaller loop so that part of them are still wound on a pole, can be passed into the frame constructions so that all the necessary members are placed inside the opened part of the fabric loop, whereupon the necessary members are placed inside the opened part of the fabric loop, the necessary tensioning and guide rolls are shifted to their outer positions in the directions indicated by the arrows V, the intermediate pieces are closed, and the tensionings of the draw members are released. In this way, a relatively quick replacement of press fabrics and/or press rolls can be achieved.

In a press section as shown in FIG. 5, for the nips $N_1$, $NP_2$, $N_3$, three identical frame units 110 are used, place one after the other. Owing to the frame unites 110 and to the compactness of their arrangement, the frame does not become detrimentally long even when three nips placed one after the other are employed.

In FIG. 6, the first frame construction, which has been modified to the necessary extent, is fitted in connection with the wire nip $N_0$, whereas the other frame units 110, which are provided for the nips $NP_1$ and $NP_2$, are similar to those described above in relation to FIGS. 7, 8 and 9.

In the following, with reference to FIGS. 10, 11 and 12, the hose rolls 200 and 300 employed in the embodiments of the extended nips NP used in the press section in accordance with the invention will be described.

Figure 10:
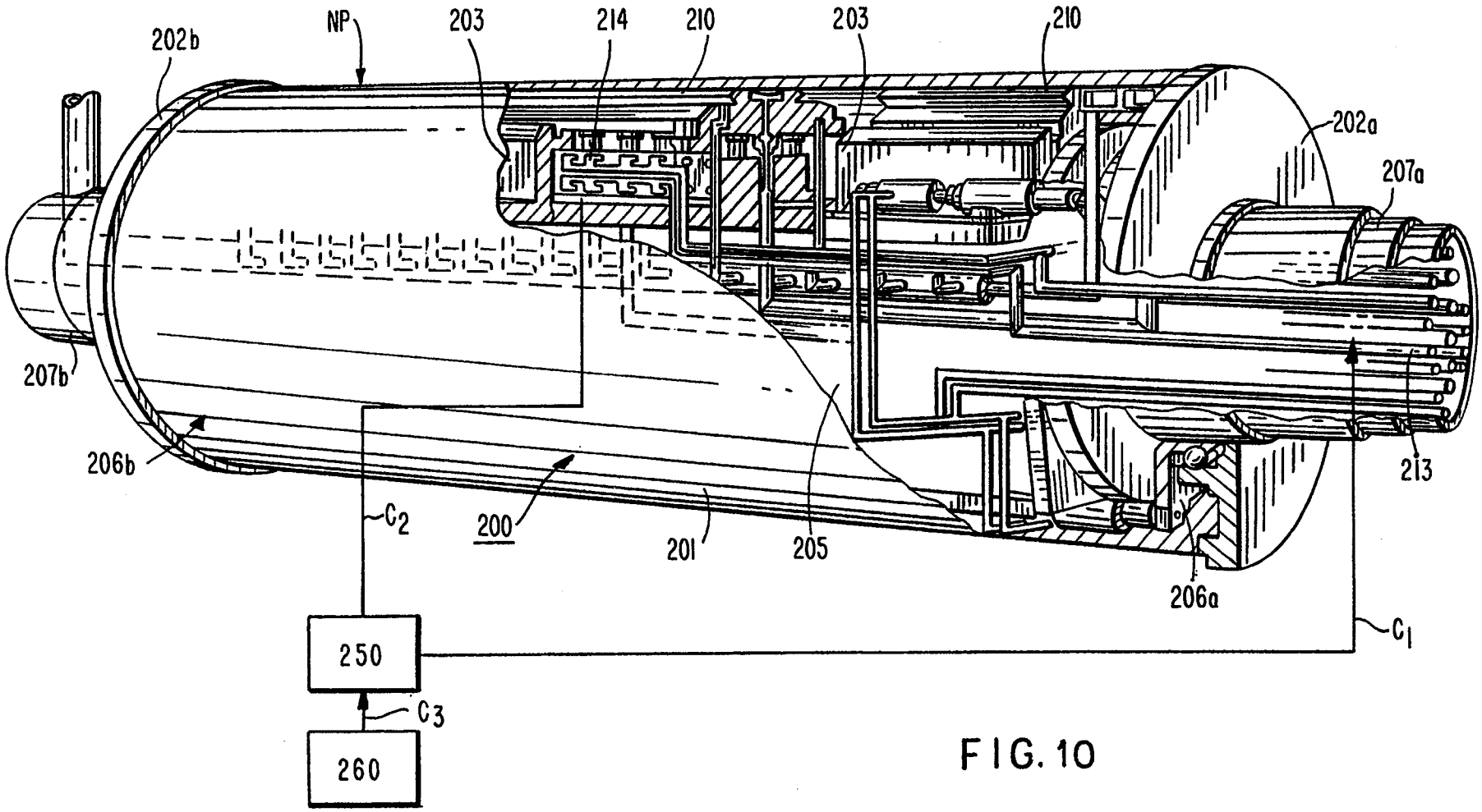
FIG. 10 is an axonometric, partly sectional view of a hose roll of a "Sym-Belt S TM" applicable in the invention.

According to FIG. 10, the hose roll 200 comprises a mantle 201, which is made, e.g., of a material that stretches very little, as a permanent stretch is very detrimental to the mantle 201. The thickness of the hose mantle 201 is, e.g., from about 2 to about 5 mm. To the hose mantle 201, annular ends 202*a* and 202*b* are fixed permanently, the inner parts of said ends being fixed and sealed against revolving axle journals 207*a* and 207*b*, which are mounted on the frame parts 110 of the machine by means of fixed bearing supports. The hose roll 200 includes a stationary inner frame 205, around which the hose mantle 201 with its ends 202*a*, 202*b* revolves on the bearings 206*a* and 206*b*.

Figure 11:
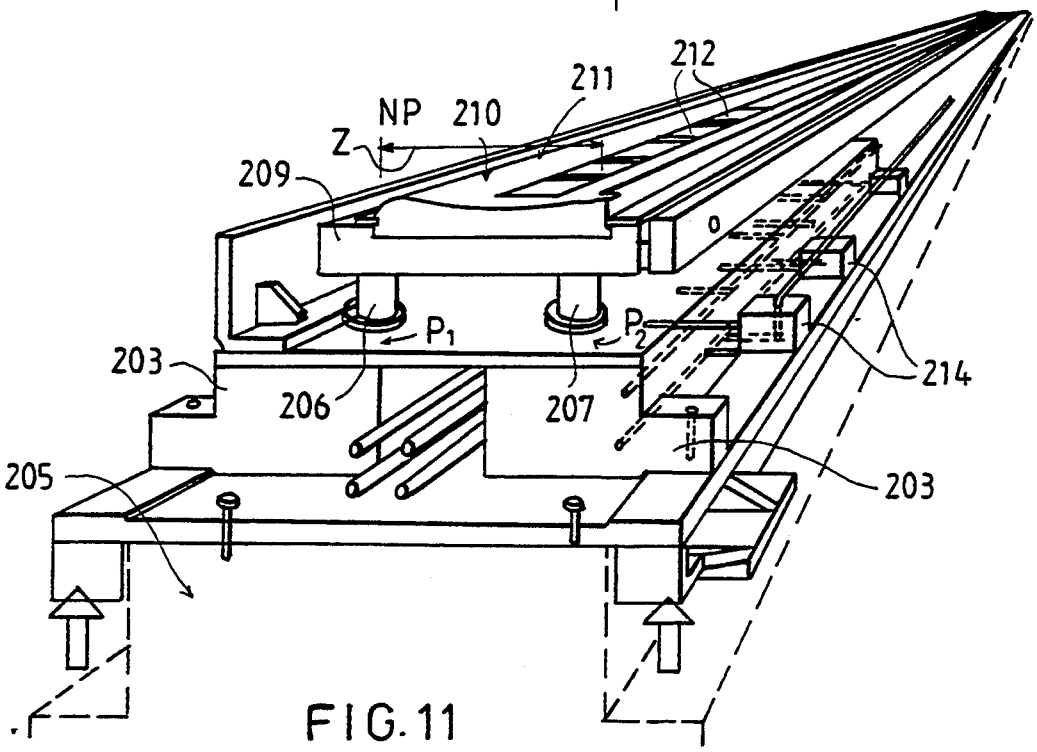
FIG. 11 is an axonometric view of a pres shoe that can be loaded and profiled in a versatile way and that is fitted inside the hose roll and employed in a press as shown in FIG. 10.

As is shown in FIG. 11, cylinder block sets 203, two sets side by side, are fitted in the inner frame 205. In the bores placed in the sets of cylinder blocks 203, hydraulic support members 206, 207 of the glide show 210 operate, which members are, thus, placed in two rows, e.g., with a spacing of about 25 cm in the transverse direction one after the other. The two rows of the hydraulic support members 206, 207 support a support plate 209, to which a glide shoe 210, e.g., of aluminum is attached, in whose area an extended nip zone NP is formed against a backup roll. The glide shoe 210 is provided with a smooth glide face 211, which operates as a press member against the smooth inner face of the hose mantle 201. The glide shoe 210 has a series of hydrostatic chambers 212 placed one after the other, which chambers contribute to the formation of a hydrostatic loading pressure and to oil lubrication of the glide face 211. Each of the subsequent cylinder blocks 203 communicates with a pipe connector 214, to which pipes 213 of loading medium pass so that a separately adjustable pressure can be passed into each individual block in the series of cylinder blocks 203. In this way, the pressure profile in an extended-nip zone NP can be regulated and controlled precisely and in a versatile way both in the machine direction and in the transverse direction. The pressure ratio $p_2/p_1$ of the two different rows of support members 206,207 is generally chosen invariably as $p_2/p_1$=from about 1.5 to about 2, whereas the pressure passed into each block is freely adjustable within certain limits.

An example of the distribution of the nip pressure in an extended-nip zone NP is such a distribution in the machine direction in which the nip pressure (the pressure applied to the web W) at the front edge of the shoe 210 rises, owning to the hydrodynamically generated pressure, to about 0.4 MPa, whereupon the pressure remains at this value as invariable, and in the trailing area of the shoe, there is still an increase in the pressure, while the peak pressure is about 7 MPa, from which value the pressure goes abruptly to Zero at the trailing edge of the shoe 210. As was stated, said distribution of pressure can be varied so as to an optimal pressing result. In any case, the compression pressure at the hose roll 200 and the distribution of said pressure in the machine direction can be arranged such that the start of the dewatering, while the dry solids content of the web W is still relatively low, can be carried out so gently that the fiber structure of the web W is not deteriorated.

In FIG. 10, a regulation system related to the invention is sketched, by whose means the pressure profiles of the extended nip NP in the transverse direction and in the machine direction can be controlled. The regulation system is illustrated by the block 250, from which a series of regulation signals $c_1$ is given which regulate the hydraulic pressures fed through the pipes 213. To the regulation system 250 a feedback signal is received from separate wirings 214, which is illustrated by the series of signals $c_2$. Further, the system 250 communicates with a measurement arrangement 260, by whose means the different profiles of the paper web W produced, such as moisture or thickness profiles, are measured, and this provides a series of feedback signals $c_3$ for the regulation system 250, which produces the series of regulation signals $c_1$.

The hose roll 200 is oil-tight, and the interior of the hose 201 can be arranged as slightly pressurized. From the glide faces 211 of the glide shoes 210, a slight leakage of oil takes place, which oil is collected from inside the hose mantle 201 and passed through the pipe 215 back to the oil circulation.

The hose roll 200 shown in FIGS. 10 and 11 is preferably mounted on fixed bearing supports, in which case the extended nip NP must be opened by means of a movement of the backup roll. This is necessary, because a play of, e.g., about 40 mm or movement of the glide shoes 210 of the hose roll is not sufficient for opening the nip NP sufficiently, e.g., for replacement of the fabrics.

Figure 12:
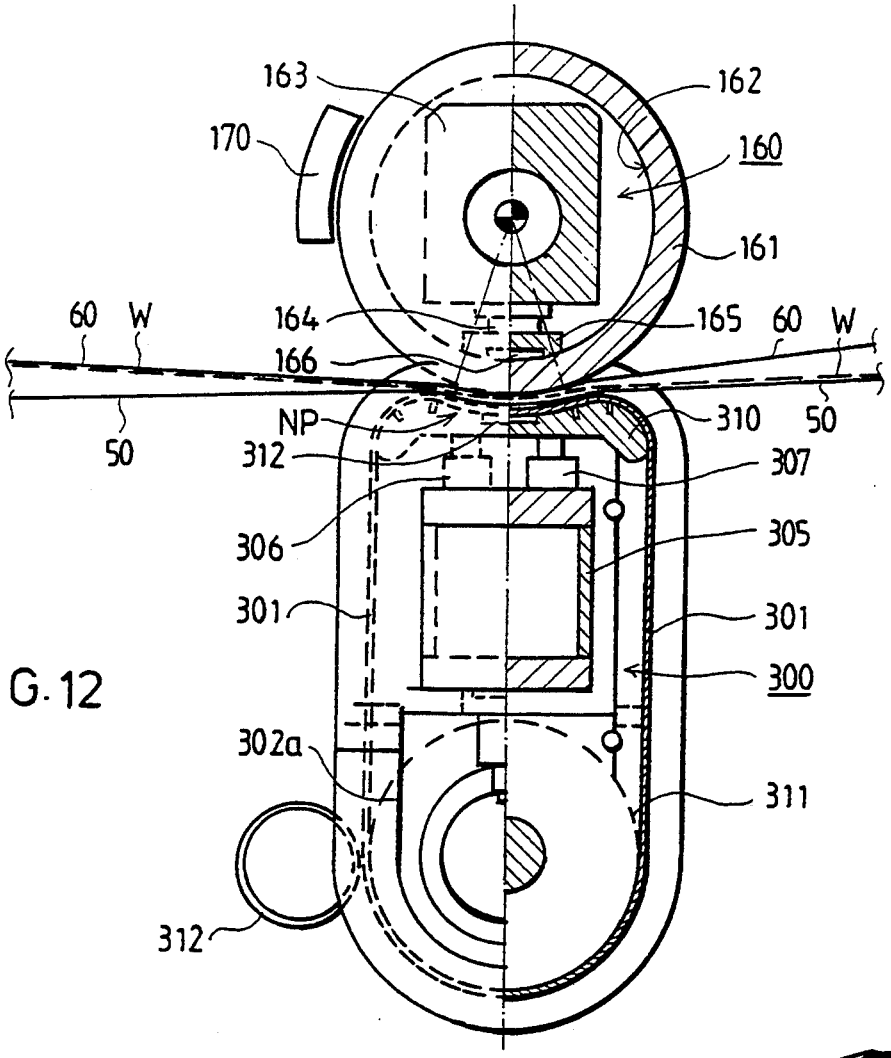
FIG. 12 shows an alternative construction that accomplishes an extended nip and that is provided with a closed glide belt loop.

FIG. 12 shows a second embodiment of a hose roll 300. Therein a band 301 loop is used that is longer than the circular hose mantle 201. Said band 301 is guided from inside, and the extended nip NP is loaded by a hydrostatically and hydrodynamically loaded glide shoe 310, which is fitted inside the band 301 loop and which has a hydrostatically loadable series of pressure fluid chambers 312 in the area of the extended nip NP. Inside the band loop 301, a beam 305 is fitted, which is provided with a series of hydraulic loading members 306 and 2307, by whose means the glide shoe 310 can be loaded in a controlled way. The band loop 301 is guided by a leading roll 311, in whose connection a spreader roll 312 is operative. Both ends of the band loop 301 are closed by means of end pieces so as to prevent oil leakages and splashes, of which end pieces one piece 312*a* is shown in FIG. 12. The more detailed embodiment of the band roll shown in FIG. 12 is shown, e.g., in the assignee's U.S. patent application Ser. No. 486,754 (corresponding to FI Patent Application No. 891380), hereby incorporated by reference.

The backup roll used in an extended nip NP as shown in FIG. 12 is an adjustable-crown roll 160, e.g. an adjustable-crown roll marketed by the assignee under the trade mark "Sym-Z Roll TM", which forms an extended nip NP by means of its sector C with the band roll 300. A corresponding roll can be used together with the hose roll 200. The roll 160 has a cylinder mantle 161, against whose smooth inner face 162 a series of glide shoes 165 operates, which is provided with hydraulic lubrication and loading chambers 166. The series of shoes 165 is loaded by means of a series of hydraulic actuators 164. If the backup roll 160 is employed together with the fabric 60 as a member that receives water, the outer face of the mantle 160 is employed together with the fabric 60 as a member that receives water, the outer face of the mantle 160 is provided with a hollow face. On the other hand, if the principal purpose of the roll 160 is to heat the web 60, e.g. by means of induction heating devices 170, a smooth mantle face is employed on the roll.

According to FIG. 12, in connection with the mantle 161 of the roll 160, a heating device is provided, e.g. an inductive heating device 170, by whose means the temperature profile of the roll mantle, and thereby the profile and the dewatering capacity of the extended nip, can be affected. The roll 160 can also be used so that it has a smooth outer face and that by its means the web W is pressed directly, in which case there is no fabric 60 in between, and in this way the web W can be heated directly, thereby affecting the viscosity of the water present in the web and the elastic properties of the web W, thus promoting the dewatering and the transverse profile of the dry solids content.

The dry solids content $k_{out}$ of the web as it departs from the press section in accordance with the invention is generally in the range $k_{out}$=from about 35% to about 65%, preferably in the range $k_{out}$=from about 40% to about 55%.

As illustrated in FIG. 12, the web W is carried on only one fabric 60 before the extended nip NP and preferably does not contact the lower fabric 50 at all before the extended nip NP. This is advantageous because the upper fabric 60 will absorb as much water as possible before the extended nip NP. Preferably, the web is sandwiched between the upper fabric 60 and the lower fabric 50 only in the extended nip NP. Preferably, almost immediately after the extended nip NP, the web is removed from its sandwiched position and is carried on only the lower fabric 50. After the extended nip NP, the water laden upper fabric 60 preferably does not contact the web further. In this manner, a substantially non-rewetting transfer of the web occurs because fabric 50 is a substantially water non-receiving fabric which does not rewet the web W.

In the following, the patent claims will be given, and the various details of the invention may show variation within the scope of the inventive idea defined in said claims and differ from the details which have been stated by way of example only.

What is claimed is:

1. A method in the manufacture of paper or board for dewatering of a paper web that is being manufactured and that has been drained in a former of a paper machine, wherein the dewatering takes place by passing the paper web on support of fabrics that receive water through a plurality of dewatering nips so that, by the effect of the compression pressure applied in said dewatering nips, water is transferred out of a fiber mesh of the paper web into spaces in the fabric that receive water as well as into spaces in the hollow faces of mobile dewatering members, comprising the steps of:

draining-pressing a web running on a forming wire by carrying the web on a single-wire run of the forming wire into a pre-pressing zone comprising an extended-nip pre-press zone having a length from about 100 to about 600 mm, draining-pressing the web in said pre-pressing zone between the forming wire and a first press fabric by applying a compression pressure from about 0.5 to about 3 MPa in said extended-nip pre-press zone by means of a press shoe situated in a loop of said first press fabric, and carrying the web on the single-wire run of the forming wire after said pre-pressing zone, transferring the paper web from the forming wire onto a wire in the drying section while constantly supporting the web by a fabric that receives water, a transfer fabric, or a corresponding transfer surface as a closed draw at a speed that is greater than about 25 m/s, dewatering the paper web in a press section by means of at least two press nips, at least one of said press nips comprising an extended-nip press zone whose length in a machine direction is greater than about 100 mm, transferring the web after each of said press nips from one of said fabrics onto an opposing one of said fabrics or onto said corresponding transfer surface, the web being transferred after at least one of said press nips such that there is a substantially non-rewetting transfer of the web after said at least one of said press nips, forming said extended-nip press zone in connection with a mobile flexible press-band loop, and regulating the distribution of the compression pressure employed within said extended-nip press zone both in a transverse direction of the web and in the machine direction so as to control different profiles of properties of the web.

2. The method of claim 1, further comprising the steps of:

transferring the paper web at a pick-up point at the beginning of said press section onto a lower face of a first upper fabric that receives water in said press section and on support of said lower face of said first upper fabric into a first press zone, transferring the web after said first press zone onto an upper face of a first lower fabric which runs through said first press zone, and supporting the web on said upper face of said first lower fabric to a first transfer point, transferring the web at said first transfer point as a closed draw onto a lower face of a second upper fabric and on support of said lower face of said second upper fabric into a second press zone, providing at least one of said first press zone and said second press zone as the extended-nip press zone, and transferring the web after said second press zone onto an upper face of a second lower fabric which runs through said second press zone, and supporting the web on said upper face of said second lower fabric and then either transferring the web as a closed draw to a second transfer point and then on to said drying section, or prior to transferring the web to a second transfer point and on to the drying section, transferring the web on said upper face of said second lower fabric onto a lower face of a third upper fabric into a third press zone.

3. The method of claim 2, wherein said third press zone comprises a roll nip and the web is transferred from said upper face of said second lower fabric onto said lower face of said third upper fabric, further comprising transferring the web after said roll nip onto an upper face of a third lower fabric of said third press zone and then transferring the web as a closed draw to a third transfer point and then on to said drying section.

4. The method of claim 3, wherein said third press zone comprises said at least one press nip after which there is a substantially non-rewetting transfer of the web.

5. The method of claim 2, wherein the web is transferred as a closed draw to the second transfer point on a substantially impervious fabric which does not receive water and does not rewet the web such that said second press zone comprises said at least one press nip after which there is a substantially non-rewetting transfer of the web.

6. The method of claim 2, further comprising starting the dewatering pressing of the web when the dry solids content of the web is about 10% and water is removed out of the web so that after the press section the dry solids content of the web is from about 35% to about 65%.

7. The method of claim 2 wherein the web is guided through said press section as a substantially straight run so that the angle of change in the direction of the web as the web moves through said press zones and from one fabric onto the other is less than about 30°.

8. The method of claim 2, further comprising carrying the web on only one of said fabrics before said extended-nip press zone such that the web does not contact, before said extended-nip press zone, a second one of said fabrics which passes through said extended-nip press zone, and transferring the web from said one of said fabrics in said extended-nip press zone such that the web is carried on only said second one of said fabrics substantially immediately after said extended-nip press zone.

9. The method of claim 2, further comprising providing said first and second press zones as a first and second extended-nip press zone, respectively, and arranging press shoes of said first and said second extended-nip press zones inside a loop of said first and said second upper fabrics, respectively.

10. The method of claim 2, further comprising providing said first and second press zones as a first and second extended-nip press zone, respectively, arranging a first press shoe of said first extended-nip press zone inside a loop of said first upper fabric, and arranging a second press shoe of said second extended-nip press zone inside a loop of said second lower fabric.

11. The method of claim 1, further comprising increasing the dry solids content of the web in an area before a last one of said press nips by arranging a steam box to operate against an outer face of the web and suction device to hold the web to a fabric on which the web runs.

12. The method of claim 1, further comprising adjusting the maximum compression pressure used in the extended-nip zone or zones to the range $p_{max}$=from about 3 to about 9 MPa, and distributing the pressure such that in an initial part of the extended-nip zone or zones, the compression pressure is increased steeply, where upon the compression pressure is kept substantially invariable, and regulating the compression pressure in a rear end of said extended press zone or zones to a compression pressure higher than said area of invariable compression pressure.

13. The method of claim 1, further comprising providing at least three press nips in said press section.

14. The method of claim 1, further comprising providing a second press fabric to contact a side of the web opposite from the side of the web contacting said first press fabric in pre-pressing zone.

15. The method of claim, 1 further comprising the step of arranging a suction roll in a loop of said forming wire such that said press shoe acts against said suction roll.

16. The method of claim 1, wherein said first press fabric is a relatively open press fabric.

17. The method of claim 1, further comprising the step of positioning said press shoe in a hose roll having a flexible glide-belt mantle.

18. A method in the manufacture of paper or board for dewatering of a paper web, comprising the steps of:

transferring the paper web from a web forming wire onto a wire in the drying section while constantly supporting the web by a fabric that receives water, a transfer fabric, or a corresponding transfer surface as a closed draw at a speed that is greater than about 25 m/s, dewatering the paper web in a press section by means of at least two press zones, transferring the web after each of said press zones from one of said fabrics onto an opposing one of said fabrics or onto said corresponding transfer surface such that there is a substantially non-rewetting transfer of the web after each of said press zones, providing at least one of said two press zones as a first extended-nip press zone whose length in a machine direction is greater than about 100 mm, draining-pressing the web running on the forming wire by carrying the web on a single-wire run of the forming wire into a pre-pressing zone comprising an extended-nip pre-press zone having a length from about 100 to about 600 mm, draining-pressing the web in said pre-pressing zone between the forming wire and a first press fabric by applying a compression pressure from about 0.5 to about 3 MPa in said extended-nip pre-press zone by means of a press shoe situated in a loop of said first press fabric, and carrying the web on the single-wire run of the forming wire after said pre-pressing zone, and regulating the distribution of the compression pressure employed within said extended-nip press zone both in a transverse direction of the web and in the machine direction so as to control different profiles of properties of the web.

19. The method of claim 18, further comprising the steps of:

transferring the paper web at a pick-up point at the beginning of said press section onto a lower face of a first upper fabric that receives water in the press section and on support of said lower face of said first upper fabric into a first press zone, transferring the web after said first press zone onto an upper face of a first lower fabric which runs through said first press zone, and supporting the web on said upper face of said first lower fabric to a first transfer point, transferring the web at said first transfer point as a closed draw onto a lower face of a second upper fabric and on support of said lower face of said second upper fabric into a second press zone, and transferring the web after said second press zone onto an upper face of a second lower fabric which runs through said second press zone, and supporting the web on said upper face of said second lower fabric and then either transferring the web as a closed draw to a second transfer point and then on to said drying section, or prior to transferring the web to a second transfer point and on to the drying section, transferring the web on said upper face of said second lower fabric onto a lower face of a third upper fabric into a third press zone.

20. A method for making paper, comprising the steps of:

forming a paper web in a forming section having a single-wire run of a forming wire, draining-pressing the web running on the forming wire by carrying the web on the single-wire run of the forming wire into a pre-pressing zone comprising an extended-nip pre-press zone having a length from about 100 to about 600 mm, draining-pressing the web in said pre-pressing zone between the forming wire and a first press fabric by applying a compression pressure from about 0.5 to about 3 MPa in said extended-nip pre-press zone by means of a press shoe situated in a loop of said first press fabric, and carrying the web on the single-wire run of the forming wire after said pre-pressing zone, transferring the web after the step of draining-pressing from said single-wire run to a press section, carrying the web through said press section as a closed draw and at a speed that is greater than about 25 m/s, dewatering the web in said press section by passing the through at least two press nips, transferring the web after at least one of said press nips from a first press fabric onto an opposing second press fabric or onto a corresponding transfer surface such that there is a substantially non-rewetting transfer of the web after said at least one of said press nips, providing one of said press nips in said press section as an extended-nip press zone whose length in a machine direction is greater than about 100 mm, transferring the web from said press section to a dryer section as a closed draw, and drying the web in said dryer section.

* * * * *